US005685532A

United States Patent [19]

Amarakoon

[11] Patent Number: 5,685,532

[45] Date of Patent: Nov. 11, 1997

[54] INTEGRAL SHEET HOLE PUNCHING AND OUTPUT INVERTING SYSTEM

[75] Inventor: Kiri B. Amarakoon, Pittsford, N.Y.

[73] Assignee: Xerox Corporation, Stamford, Conn.

[21] Appl. No.: 652,217

[22] Filed: May 23, 1996

[51] Int. Cl.[6] ..... B42B 5/00

[52] U.S. Cl. ..... 270/58.07; 270/58.13

[58] Field of Search ..... 270/58.01, 58.07, 270/58.08, 58.13

[56] References Cited

U.S. PATENT DOCUMENTS

| | | | |
|---|---|---|---|
| 4,819,021 | 4/1989 | Doery | 355/13 |
| 5,065,996 | 11/1991 | McGraw et al. | 271/176 |
| 5,409,201 | 4/1995 | Kramer | 270/58.13 |
| 5,409,202 | 4/1995 | Naramore | 270/53 |
| 5,551,681 | 9/1996 | Ferrara | 270/58.08 |

OTHER PUBLICATIONS

IBM Technical Disclosure Bulletin vol. 22, No. 8A, Jan. 1980 Oscillating Multiple Pattern Rotary Punch, by: L.A. Walker.

*Primary Examiner*—John T. Kwon

[57] ABSTRACT

In a printing system on-line sheet output system with a rotating disks type sheet inverter and stacker in which the printed sheets are individually registered and rotated for inversion before being released for stacking while partially held in slots in the disks, an integral on-line hole punching system is provided for selectively outputting those sheets with or without a preselected hole pattern. A plurality of laterally repositionable sheet punches are integrally rotatable with the sheet inverter disks and positioned to punch a sheet while that sheet is moving and being individually rotated for inversion by the disks, by engagement of the punches by sheet punch actuators, before that sheet is released for stacking. The sheet punches may be sequentially and/or profiled cam gradually activated as the sheet is rotated to reduce the maximum required sheet punching force.

6 Claims, 4 Drawing Sheets

INTEGRAL SHEET HOLE PUNCHING AND OUTPUT INVERTING SYSTEM

The disclosed embodiments relate to an improved system of on-line selectable hole punching of printed sheets of paper or the like as they are being outputted by a copier or printer, which is simple, low cost, and compact, and can be integrated entirely within the existing space of an inverter/stacker type sheet output system.

Users of copiers, printers, or other reproduction devices frequently desire their print jobs to be outputted as sets of printed sheets already prepunched, so that the job sets can be directly put into three ring, two ring, or other standard notebooks or binders requiring sheets with holes of the appropriate number and spacing from the edge margin of the sheet and from one another.

Commonly, this is provided by loading prepunched paper stock into the copier or printing and then printing on those prepunched sheets. This has, however, several disadvantages. First, it required pre-ordering, purchasing, stocking and warehousing of such special prepunched paper, so that it is available when such print jobs are needed. Several different weights, sizes, and/or colors of such special use prepunched paper may be required to be stored on hand, with associated inventory costs. Secondly, prepunched holes in the sheets can interfere with proper feeding or printing of such sheets; for example, by falsely actuating or triggering lead or trail edge sheet sensors in the sheet feeding path of the printer or copier. Thirdly, since the first or odd page of the print job must have the prepunched holes on the left margin of the sheet, not the right margin, and so forth for subsequent pages, the orientation in which such prepunched sheets are loaded into the copier or printer is critical for proper orientation of the printed image relative to the holes. Such prepunched stock is, of course, not even available for roll or web fed copiers or printers as opposed to sheet fed copiers or printers.

To overcome the above and other disadvantages of prepunched (also referred to as predrilled) paper stock, some copiers have begun to offer on-line hole punching of the sheets during or immediately after the printing process in the copier, so that conventional unpunched blank copy sheet stock may be utilized, yet provide appropriately punched print jobs in the output. Also, it has been suggested in prior patents. Noted, for example, is Xerox Corporation U.S. Pat. No. 4,819,021 issued Apr. 4, 1989 to Michael S. Doery, noting particularly the left-hand sides of FIGS. 3 and 4 and Col. 8 (Attorney Docket No. D/86170). IBM Technical Disclosure Bulletin Vol. 22, No. 8A, January, 1980, pages 3119–3120, discloses a multiple pattern rotary punch of a type previously used for punching rolls of web-like material, for use in in-line copier or offset press oscillatory punching of single copy sheets. The punch device disclosed can be fitted with different arrays of hole patterns, it is also stated. Mead Corporation U.S. Pat. No. 4,575,296 issued Mar. 11, 1986 to Kockler, et al, especially the bottom of Col. 3, and reference No. 40, also suggests on-line hole punching. Also, Canon U.S. Pat. No. 4,763,167 issued Aug. 9, 1988 to T. Watanabe, et al; and Mita U.S. Pat. No. 5,508,799. On-line hole punching of the copier output is believed to have been available in a Konica "7090 RF" product since approximately 1988. See especially Konica U.S. Pat. No. 4,988,030.

These references also note that on-line hole punching can be provided with or without stapling or other set binding in addition thereto, a feature for which the disclosed embodiments are also compatible. E.g., the on-line set stapling provided by the "Integral Disk Type Inverter-Stacker and Stapler" of Xerox Corporation U.S. Pat. No. 5,409,202 issued Apr. 25, 1995 to Raymond A. Naramore and William E. Kramer.

The above-cited U.S. Pat. No. 5,409,202 is also of particular interest for its teachings, directly and via other disk stacker references cited therein, of disk type inverter/stackers in general, and one suitable for the exemplary embodiments herein in particular. As will be further described herein, the disclosed embodiments integrally incorporate an on-line hole punching system into a disk type inverter/stacker in a manner which is fully compatible with and cooperatively utilizes the sheet entrainment and movement provided by the disk type inverter stacker, and other elements thereof. This integrated system enables optional on-line hole punching to be provided in the output sheets without any increase in the overall size of the sheet output system, or any reduction in printing speed. Also, the sheet punching as disclosed herein is desirably at the exposed output end of the printing system, and therefore is readily accessible for adjustments, repairs, and, most importantly, jam clearances of any sheet jams or removal of sheets during machine stoppages. That is, the hole punching system disclosed herein is not buried internally within the copier or printer in an access-restricted location.

Another important advantage of the disclosed integral hole punching and inverting/stacking embodiments is that the hole punching is accomplished on-line yet without having to stop the sheet, even briefly, for the hole punching, as in various of the above-cited references. Yet, the sheet edge is registered and deskewed before and during hole punching here, which is essential for proper positioning of the punched holes in the sheets and for consistent hole positions in the outputted set. Not only is the edge of the sheet being punched here registered, the existing transverse registration system of the existing inverter/stacker, of, for example, said cited U.S. Pat. No. 5,409,202, may be desirably utilized to provide transverse registration of the sheet prior to its hole punching as well. That is, both of the existing process direction and lateral registration systems provided by the disk type inverter/stacker can provide a dual mode function, in that they can also provide both forward and lateral registration of the sheet for punching of the desired pattern of holes therein in the proper positions therein, all while the sheet continues to move. The disclosed embodiments utilize the existing registration ends of the slots in the disk for registering the sheet lead edge in the process direction, and the existing side edge tamping mechanism acting on the side edges of the sheet, for registration of the sheet into the proper hole punching position, all of which is done as the disk rotates to transport the sheet toward the stack and invert it, using the existing drive and registration features of the disk stacker.

Continuing movement of the sheet before and during hole punching provides significant advantages, including allowing maximum productivity of the copier or printer by not requiring increased time and space between succeeding outputted sheets, i.e., a subsequent sheet is not catching up with or overtaking the preceding sheet being punched. Furthermore, the rapid deceleration and acceleration of sheets required if the sheet has to be stopped for punching is eliminated. Such rapid deceleration and acceleration of sheets can itself lead to skewing or other misregistration of a sheet due to drive slippage.

Further advantages of the disclosed embodiments, as will be apparent, include tech rep, operator or user adjustability of the position and/or number of punched holes in the sheet. Other disclosed advantages or optional features include sequential actuation of the punches, and/or leverage enhancing camming systems, to reduce the maximum force or effort required for the hole punching. That force is also reduced by the fact that here only one sheet at a time is punched, rather than a whole set.

It will be appreciated that while the ability to utilize existing disk stacker/inverter components is one of the advantages of the disclosed embodiments, that some of those components may be desirably be strengthened or made more robust or otherwise altered to better adapt them to the integral hole punching features here.

A specific feature of the specific embodiments disclosed herein is to provide in a printing system on-line sheet output system comprising a rotating disks type sheet inverter and stacker in which the printed sheets being outputted are individually rotated for inversion before being released for stacking while being at least partially held in said rotating disks; the improvement comprising an integral on-line hole punching system for selectively outputting selected printed sheets with punched holes in a preselected punched hole pattern, said integral on-line hole punching system comprising a plurality of sheet punches integrally rotatable with said rotating disks and positioned to engage and hole punch a sheet while that sheet is being individually rotated for inversion in said rotating disks, and sheet punch actuators for actuating said sheet punches while a sheet is being individually rotated for inversion in said rotating disks and before that sheet is released for stacking.

Further specific features disclosed herein, individually or in combination, include those wherein said plurality of sheet punches are sequentially activated by said sheet punch actuators as said sheet is rotated by said disks to reduce the maximum required sheet punching force; and/or wherein at least some of said sheet punches are laterally repositionable transverse the axis of rotation of said disks to provide for different said preselected punched hole patterns; and/or in which said disks have sheet holding slots terminating in downstream closed registration slot ends aligned with one another to register the downstream edge of a sheet, and said sheet punches are all positioned to punch sheets in said slots at a preset distance upstream from said slot ends to automatically place said punched holes in said sheet aligned with one another and spaced upstream of said downstream edge of a sheet by said preset distance; and/or in which said sheet punch actuators comprise fixed cam actuators engaging cam followers driving said sheet punches into the sheet; and/or in which said cam followers include punch force multiplying levers.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. Conventional sheet path sensors or switches connected to the controller may be utilized for sensing, counting, and timing the positions of sheets in the sheet paths, and thereby also controlling the operation of sheet feeders and inverters, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

Figure 1:
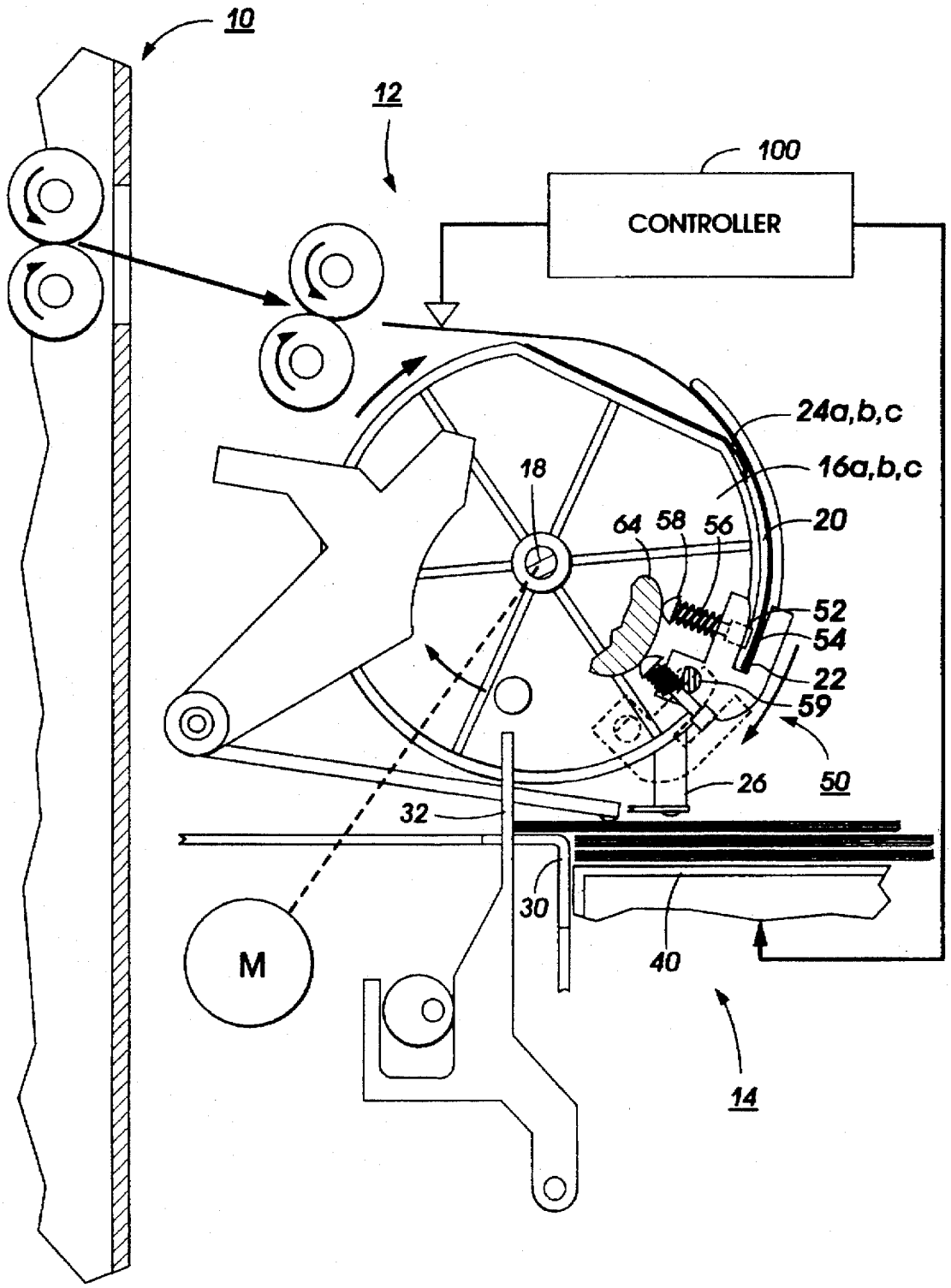
FIG. 1 is a side view of one example of an integral sheet hole punching and inverter/stacker output system, shown at the output of a sheet-printing system.

Referring to the specific examples shown in the Figures, there is illustrated schematically the output end of an otherwise conventional printing system 10, sequentially feeding ifs printed sheet output into a connecting finisher module directly associated therewith for on line finishing, exemplified here by a sheet output system 12, including a disk inverter/stacker/stapler system 14 having an integral hole punching system 50.

The inverter/stacker system 14 in this example is similar to that described in more detail in the above-cited U.S. Pat. No. 5,409,202, and accordingly need not be described in detail herein except as to the important modifications thereof for the hole punching system 50 to be subsequently described. As in the system of said U.S. Pat. No. 5,409,202, the outputted printed sheets are fed by exit roller nips into the disk inverter/stacker system 14, which at that point of sheet entry is positioned or parked with its disks 16*a*, 16*b*, 16*c* positioned to receive the lead edge of the incoming sheet in the disk slots 20*a*, 20*b*, 20*c* on the disks. The three disks 16*a* 16*b*, 16*c* are rotated together on and by their central mounting shaft 18 by a motor M as the sheet continues to be fed further into the slots 20, until the sheet lead edge engages the disks registration slot ends 22*a*, 22*b*, 22*c*, which are aligned and therefore provide deskewing and sheet lead edge registration of the incoming sheet. Retaining springs 24*a*, 24*b*, 24*c* may be provided in their respective disk slots to help confine and retain the sheet which is now in the process of being inverted with the continued rotation of the disks 16. During that rotation, at least one lateral edge of the sheet is engaged by lateral sheet tamping system 26 which tamps or slides the sheet laterally in the disk slots 20 into the desired lateral sheet registration position. Thus, the sheet is both forwardly and laterally registered in the disk slots 20 while the sheet is moving therewith. After the sheet has reached its desired lead edge registration position 32 for stacking, the sheet is released or stripped off for stacking in a stacking position 34 on a stacking tray 40.

All of the above is described in more detail in said U.S. Pat. No. 5,409,202 for this example. It will be appreciated that this is merely one example and that other disk inverter stacker operations and registration systems are known, some of which are described in other disk type inverter stackers cited in same U.S. Pat. No. 5,409,202. As further described in said U.S. Pat. No. 5,409,202, additional optional features are a movable registration edge system for pushing the sets further out onto the stacking tray 40 after a set of sheets has been compiled and stapled by an integral stapling system or other set finishing system, where set binding is desired.

Turning now to the exemplary hole punching system 50 illustrated in this example, it may be seen that it is fully integrated into the disk inverter/stacker system 14. In this example, three sheet punch assemblies 52*a*, 52*b*, and 52*c* are provided, so as to provide for standard three hole punching. As will be described, the punching of the three respective punches can be sequential and applied much more gradually than with a solenoid punch, for lower impact and quieter operation. Also, since the punch assemblies 52 here rotate with the disk inverter/stacker system 14, if they were solenoid actuated, they would require rotating electrical connections to a power supply. With the system disclosed herein, no electrical power is required and the punching is accomplished from the existing drive of the system 14 by its existing drive motor M.

Figure 2:
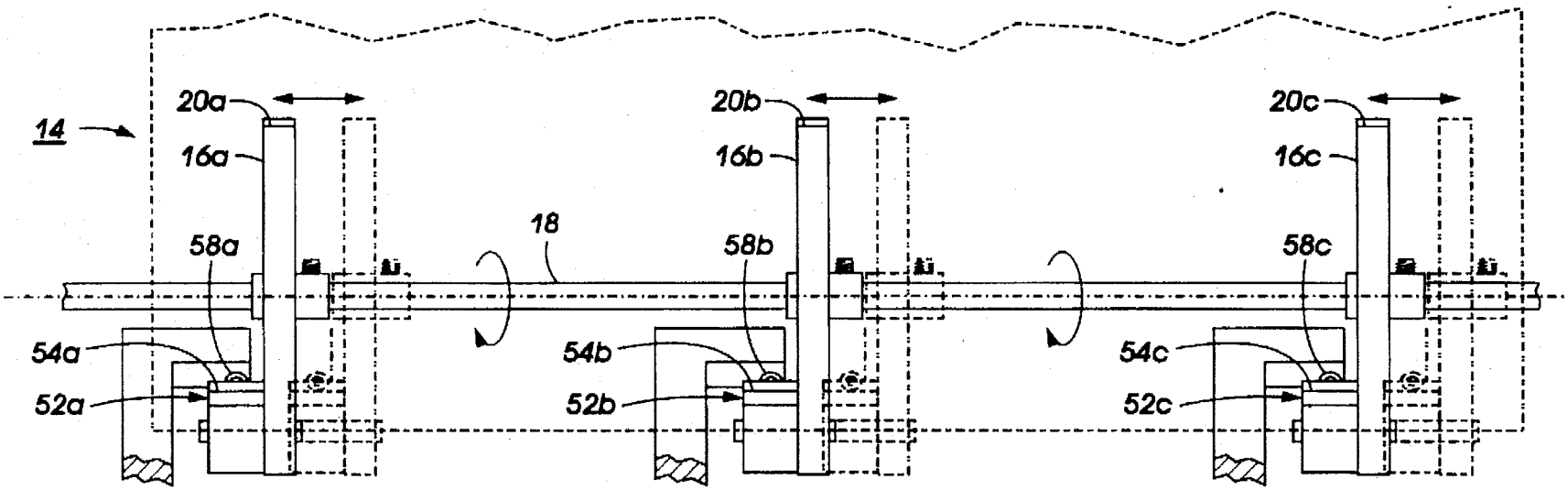
FIG. 2 is an end view of the embodiment of FIG. 1.
Figure 3:
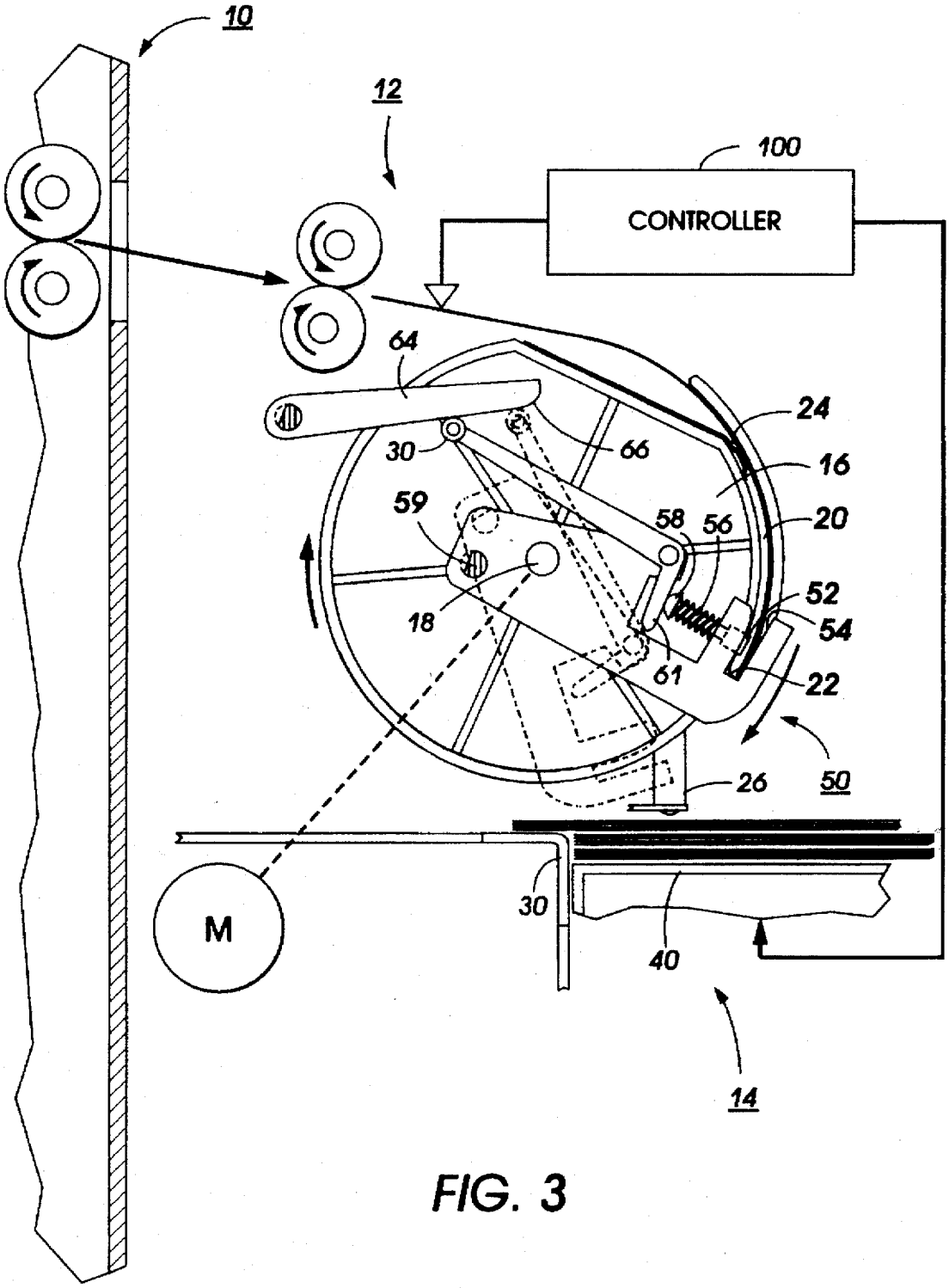
FIG. 3 is a slightly different alternative embodiment of the integral system of FIGS. 1 and 2.
Figure 4:
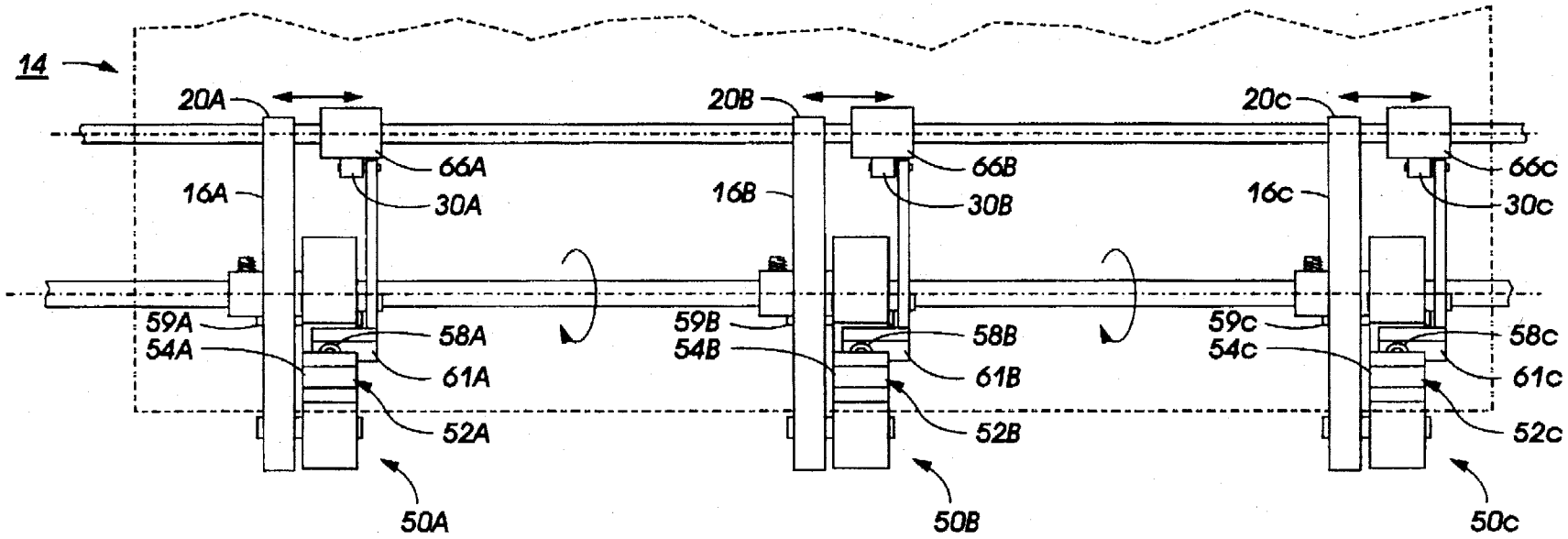
FIG. 4 is an end view of the embodiment of FIG. 3.

The three sheet punch assemblies 52*a*, 52*b*, and 52*c* have respective jaws (55*a*, 54*b*, and 54*c*) or acquisition slots for acquiring a lead edge margin of the sheet therein for punching. A cylindrical punch (56*a*, 56*b*, and 56*c* ) of the standard hole punch diameter moves from the inside of the jaws toward the outside. Each punch has a conventional tapered sharp edge front face to punch a round hole in the sheet while the sheet is in the disk slots 20 at the appropriate hole positions. Each punch operates whenever the respective punch head thereof (58*a*, 58*b*, 58*c* ) is engaged and driven in by the punch actuating system 60. The punch heads 58 themselves can be cam followers, as in FIGS. 1 and 2, or, as shown in FIGS. 3 and 4, may be engaged by an intermediate force multiplying lever system such as 61*a*, 61*b*, 61*c*.

Each sheet punch assembly 52*a*, 52*b*, 52*c* is mounted independently of one another for lateral repositioning here. The punch assemblies 52 may be respectively integral the disks 16, and the disks 16 may be laterally resettable laterally slidable along the disk shaft 18 to suit the particular customer desired hole punching positions. For example, the preset positions of the three punch assemblies 52*a*, 52*b*, and 52*c* may be as shown in FIG. 2 in solid lines, and be repositionable as shown there in phantom lines. For two hole punching, the punch assemblies 52*b* and 52*c* may be moved into the desired hole positions thereof and the third or outboard punch assembly 52*a* may be moved laterally completely out of the sheet path for that size sheet, so as to be inoperative.

Alternatively, each punch assembly can be laterally slidable on a punch slide shaft mounting 59, (see FIG. 3) and/or the existing mounting shaft 18 of the disks 16. The punch slide shaft 59 may run parallel to and spaced from the shaft 18 and rotate with the disks 16*a*, 16*b*, and 16*c*, as illustrated in FIG. 3. In either case, set screws or other detents may be utilized to hold the punch assemblies in their selected lateral positions. They are not subjected to any significant lateral forces.

Alternatively, or additionally, the camming system, such as the lever systems 61, may be removed or disengaged for one or all of the punch assemblies 52*a*, 52*b*, and 52*c* when hole punching is not desired. As shown in FIGS. 3 and 4, the lever systems 61*a*, 61*b*, and 61*c* may have cam follower rollers 62*a*, 62*b*, and 62*c* at their respective outer lever ends. These rollers 62*a*, 62*b*, and 62*c* are sequentially engaged during only that portion of the rotation of the inverter/stacker system 14 in which hole punching is to be accomplished by fixed position cams 64*a*, 64*b*, and 64*c* respectively mounted to the frame of the output system 12. These three cams 64*a*, 64*b*, and 64*c* have cam surface profiles 66*a*, 66*b*, and 66*c* designed to provide the appropriate progressive, gradual, hole punching movement of the punch heads 58 for their respective punches 56 at the appropriate rotational positions of the disks 16.

As may be seen, all of the punching elements here in these examples are built into the disk assembly of the disk inverter/stacker system 14, and rotate therewith, except for the cam actuators.

It will be appreciated however that many other alternatives can be provided, especially for the punch actuating system 60, which is not limited to a lever system. For example, the cam profiles could be built into the punch assembly itself. Another alternative would be to provide a fixed actuating cam directly in the path of the punch heads 58, eliminating any lever systems such as 61.

The use of a lever system such as 61 can also help provide a slower or more gentle and longer punching stroke of the punches 56 and yet also provide a shorter or faster punch retraction stroke, depending on the selected cam profiles and levers, to further reduce the maximum force requirement for the punching as well as vibrations or noise. Since only a single sheet is being punched, the total punching movement or stroke can be less than 2 mm.

Once the sheet punching has been accomplished, the respective punches 56*a*, 56*b*, and 56*c* may be conventionally retracted back to their initial positions to reopen the jaws 54 for a subsequent sheet by a spring under each punch head 58, as shown. By contouring a gradual retraction of the cam profiles 66 of the punch actuating system 60, this retraction of the punches 56 can be made gradual, and thus further eliminate shock loads or acoustic noise in the system.

Note that in prior ad systems in which the sheet must be stopped for hole punching, system constraints on such a sheet stoppage time delay in order to avoid impacts on overall printer output productivity require that all three holes must normally be punched simultaneously. In contrast, here, since the punching operations can be done over a substantial movement distance of the sheet, over a substantial rotational angle of movement of the disk, the punching operations can be done sequentially and progressively, and therefore the maximum force required is a third or less of that for when three-hole paper punching is done simultaneously with the paper stationery. This sequential punching advantage is further amplified by the above described ability to utilize relatively slow punching movements for further reduced peak driving forces. Again, that is enabled by the extra time allowed here for punching while the sheet is moving and continuously held in proper registration position within the disk slots 20. It is believed that the maximum force requirements here for punching can be as low as one-tenth of a kilogram at the cams actuating the punches.

While the embodiments disclosed herein are preferred, it will be appreciated from this teaching that various alternatives, modifications, variations or improvements therein may be made by those skilled in the art, which are intended to be encompassed by the following claims:

I claim:

1. In a printing system on-line sheet output system comprising a rotating disks type sheet inverter and stacker in which the printed sheets being outputted are individually rotated for inversion before being released for stacking while being at least partially held in said rotating disks; the improvement comprising an integral on-line hole punching system for selectively outputting selected printed sheets with punched holes in a preselected punched hole pattern, said integral on-line hole punching system comprising a plurality of sheet punches integrally rotatable with said rotating disks and positioned to engage and hole punch a sheet while that sheet is being individually rotated for inversion in said rotating disks, and sheet punch actuators for actuating said sheet punches while a sheet is being individually rotated for inversion in said rotating disks and before that sheet is released for stacking.

2. The integral disks inverter stacker and on-line hole punching system of claim 1 in which said plurality of sheet punches are sequentially activated by said sheet punch actuators as said sheet is rotated by said disks to reduce the maximum required sheet punching force.

3. The integral disks inverter stacker and on-line hole punching system of claim 1 in which at least some of said sheet punches are laterally repositionable transverse the axis of rotation of said disks to provide for different said preselected punched hole patterns.

4. The integral disks inverter stacker and on-line hole punching system of claim 1 in which said disks have sheet holding slots terminating in downstream closed registration slot ends aligned with one another to register the downstream edge of a sheet, and said sheet punches are all positioned to punch sheets in said slots at a preset distance upstream from said slot ends to automatically place said punched holes in said sheet aligned with one another and spaced upstream of said downstream edge of a sheet by said preset distance.

5. The integral disks inverter stacker and on-line hole punching system of claim 1 in which said sheet punch actuators comprise fixed cam actuators engaging cam followers driving said sheet punches into the sheet.

6. The integral disks inverter stacker and on-line hole punching system of claim 3 in which said cam followers include punch force multiplying levers.

* * * * *